US012729025B1

(12) United States Patent
Greenbaum et al.

(10) Patent No.: US 12,729,025 B1
(45) Date of Patent: Sep. 8, 2026

(54) FORCED AIR PACKAGE REDIRECTION SYSTEMS FOR IMPROVED FILL RATES

(71) Applicant: Amazon Technologies, Inc., Seattle, WA (US)

(72) Inventors: Adam Joseph Greenbaum, Waltham, MA (US); Ryan Neal Wasserman, Malden, MA (US); Akshay Prashant Nawathe, Waltham, MA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 19/233,949

(22) Filed: Jun. 10, 2025

(51) Int. Cl.
*B65B 35/28* (2006.01)
*B65B 35/58* (2006.01)
*B65B 57/14* (2006.01)

(52) U.S. Cl.
CPC ..... *B65B 35/28* (2013.01); *B65B 35/58* (2013.01); *B65B 57/14* (2013.01)

(58) Field of Classification Search
CPC ..... B65B 35/28; B65B 35/58; B65B 57/14
See application file for complete search history.

(56) References Cited

U.S. PATENT DOCUMENTS

| | | | | |
|---|---|---|---|---|
| 3,453,800 | A * | 7/1969 | Mahncke | B65B 35/28 198/456 |
| 10,668,506 | B2 * | 6/2020 | Erden | B65G 47/96 |
| 11,802,008 | B2 * | 10/2023 | Christen | B65G 17/345 |
| 2007/0084744 | A1 * | 4/2007 | Appelbaum | B65B 51/026 206/462 |
| 2020/0247617 | A1 * | 8/2020 | Watanabe | B65G 43/08 |
| 2022/0380078 | A1 * | 12/2022 | Lindblad | B65B 57/02 |

FOREIGN PATENT DOCUMENTS

| | | | | |
|---|---|---|---|---|
| CN | 109153521 B | * | 7/2020 | B65H 29/241 |
| EP | 0761545 A2 | * | 3/1997 | B65G 47/525 |
| KR | 970059042 A | * | 8/1997 | B65B 35/38 |

* cited by examiner

*Primary Examiner* — Lucas E. A. Palmer
(74) *Attorney, Agent, or Firm* — Eversheds Sutherland (US) LLP

(57) ABSTRACT

Systems and methods are disclosed for forced air package redirection for improved fill rates. In one embodiment, an example sortation system may include a diverter configured to guide packages into a container, a first air delivery device configured to direct air at the package, a sensor configured to image the container, and a controller configured to determine, using the sensor, a position for a first package to be positioned in the container, determine the first package is adjacent to the first air delivery device, and cause the first air delivery device to be actuated, such that the air is directed at the first package. The air impacts the first package and causes the first package to change a direction or trajectory of movement of the first package.

20 Claims, 7 Drawing Sheets

FORCED AIR PACKAGE REDIRECTION SYSTEMS FOR IMPROVED FILL RATES

BACKGROUND

As users increasingly make online purchases, fulfilment of such purchases and other orders may become increasingly complicated. For example, a fulfillment center may have output of upwards of one million packages per day. With such demands, efficiency of logistics related to processing orders and packages may be important. Accordingly, improvements in various operations of order fulfillment, such as improvements to picking technology, sorting technology, packing technology, and so forth may be desired, such that throughput can be increased and sustainability can be improved.

Figure 1:
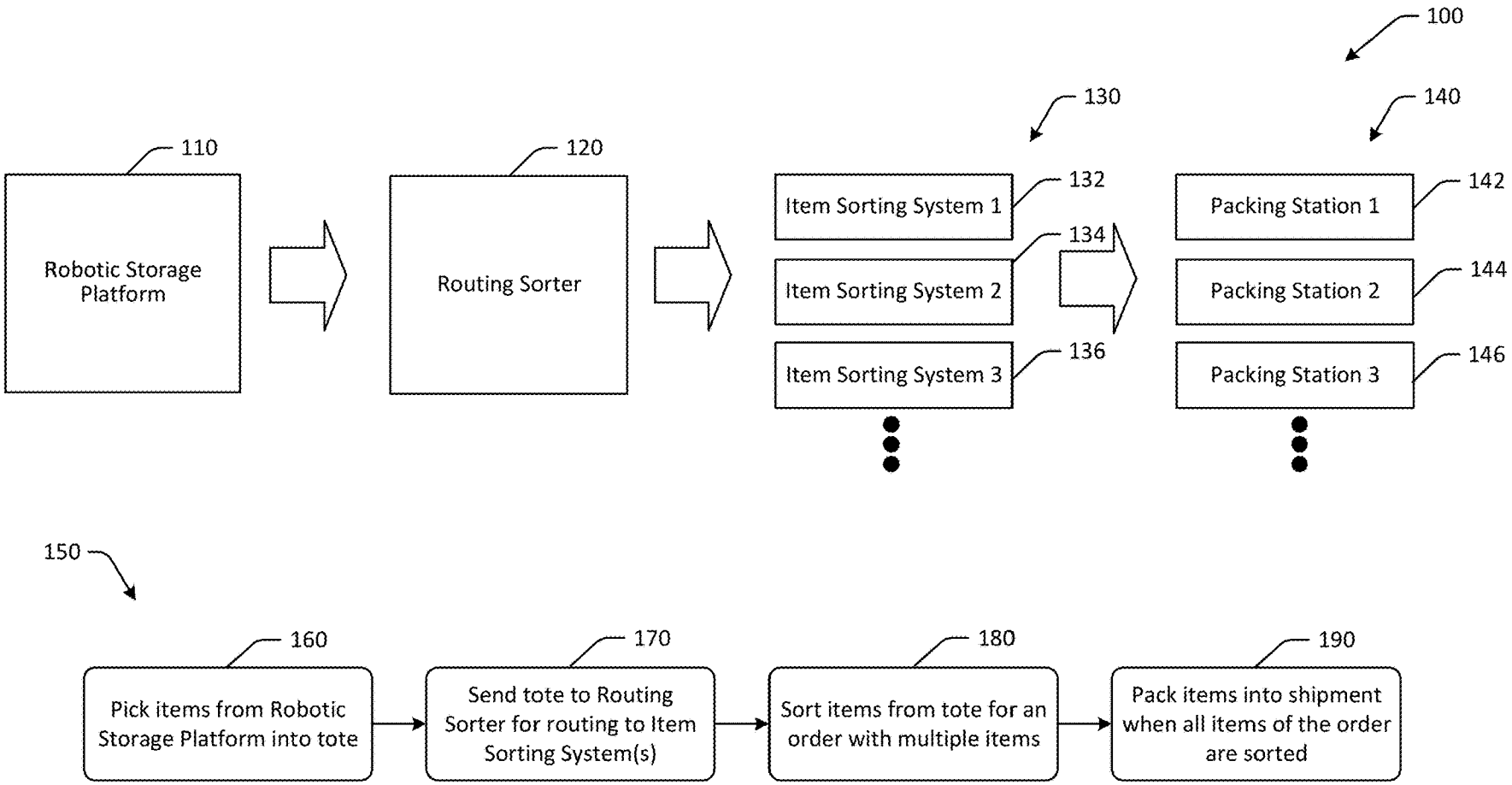
FIG. 1 is a hybrid schematic illustration of an example use case for forced air package redirection systems for improved fill rates and an example process flow in accordance with one or more embodiments of the disclosure.

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. The use of the same reference numerals indicates similar, but not necessarily the same or identical components. Different reference numerals may be used to identify similar components. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Overview

Fulfillment centers may be used to fulfill online purchases and other orders. For example, fulfillment centers may include product inventory that may be pulled when an order for a particular product or multiple products is placed. In some instances, the product(s) may be packed and shipped from the fulfillment center. However, the process of obtaining the product(s), packing the product(s), and shipping the product(s) may be complicated due to the amount of inventory, the number of orders to process, the size of the fulfillment center, and/or other factors. In addition, a portion of the fulfillment center designated for packing or shipping may be different than the portion of the fulfillment center designated for holding product inventory. As a result, transportation of products and/or shipping of packages in an order may be time consuming. Moreover, ingesting items into storage may require emptying or unloading of containers that have items therein, where the items can be emptied and then processed, such as sorted, routed to storage locations, and so forth.

In some instances, orders for products may include multiple items. For example, a user may place an order for two or more products. In such instances, the products that are ordered may not be in the same location of the fulfillment center, or one of the products may take a longer time to obtain or pick than the others. As a result, packing of the order may be delayed until all of the items in the order are ready for packing. To improve the speed of processing orders, in certain instances, robots and other technology may be deployed, such that manual efforts can be redirected to other tasks. For example, robots may be used to assist with locating products in an order during a pick process. However, directing picked products to the appropriate packing station and/or location may form a bottleneck in the operation of the fulfillment center. For example, after products are picked, the products may be placed in a container, such as a tote or other container, and directed to sortation machines to direct the picked products to the appropriate packing location. Products in the same order may be directed to the same packing location for consolidation and subsequent packing. However, a tote or other container may include products that are to be sorted to multiple different packing locations, and the sortation process may be slowed by sheer volume of products that are to be processed and/or sorted. In addition, in some instances, items that are part of the same order may not all be in the same fulfillment center or other location. For example, a first product in an order of two items may be at a first fulfillment center, and a second product in the same order may be at a second fulfillment center. In such instances, instead of shipping the two items in the order separately, such as one from each fulfillment center, items may be transferred from one fulfillment center to another, and then aggregated with other items in the order and shipped together. Such fulfillment center-to-fulfillment center transfers of items may be processed similar to items that are to be shipped to consumers. For example, the items to be transferred may be picked, routed to a sortation machine, sorted into a particular container (e.g., a container designated for a particular fulfillment center, etc.), packed, and sent. In some instances, containers destined for other fulfillment centers may be infinite bottom containers, or containers that may be filled without consideration of a level of fullness or remaining capacity of the container. In such instances, capacity of the containers may be monitored externally (e.g., by a user manually, by a camera system automatically, using different sensors, etc.). Full containers may be removed from a sortation system and replaced with an empty container to continue aggregating items destined for a fulfillment center. For such sortation processes, particularly where packages are sorted into containers, such as carts, gaylords, or other types of containers, forced air package redirection systems for improved fill rates may be used to increase utilization of such containers.

In some facilities, such as fulfillment and sort centers, packages are sorted into destination containers (e.g., carts, shuttles, etc.) for transit to the next portion of their journey. In some instances, packages are loaded into containers via a gravity-fed, direct drop chute. In such container building processes, a sortation system, which may be include robotic drive units and/pr or conveyance with actuation (e.g., shoe sorters, cross-belt sorters, etc.) divert packages into the intended chute. The package is then conveyed down the chute into the waiting container. Packages may drop into the container without control as to where they land. As a result, some containers fill unevenly, and filling may stop when the container surface reaches a certain height, even if there is available volume in the container. The item can enter a chute, such as a gravity-fed, direct drop chute, and be directed into a container for further transportation or storage. Using gravity-fed, direct drop chutes, it can be the case that items land in various locations in the container.

Embodiments of the disclosure include forced air package redirection systems for improved fill rates. Various aspects of forced air package redirection systems are described herein that provide for more even filling of containers and the like. In some examples, a control system is used in combination with one or more air delivery systems that output air to change the direction and/or trajectory of the package prior to entry into the container. The air delivery system may be adjacent to a diverter. The diverter could be a chute, conveyor, roller conveyor, or other type of diverter to direct items into a container. The control system is used to manipulate the position, angle, direction, etc. of a package as it moves along or exits the diverter and enters the container. Such systems may evenly fill the container or bin positioned at the exit of the diverter. In addition, a fill sensor could be used in combination with the control system to detect a fill level of the container, the position of an item in the container, as well as a void, or unfilled area, within the container. The controller is configured to determine a desired ejection path for a package. The desired ejection path can be implemented using one or more air delivery systems to move the package laterally and/or increase or decrease a speed of the package or its trajectory as it falls into the container. Thus, according to various examples, the system described herein can increase the efficiency of materials handling facilities, such as fulfillment centers, by controlling the angle, direction, trajectory, and/or speed at which each item is ejected from the diverter, thereby providing for even filling of containers. Some embodiments automate the transition and/or handling of items at a materials handling facility. A materials handling facility may be a sort center, shipping center, packing center, distribution center, or other shipping, handling, or packing facility, among similar facilities. Some embodiments use a jet of compressed air to provide additional horizontal velocity to packages coming down the chute or diverter, so as to encourage those packages to settle on the far side of the cart.

Embodiments may therefore increase throughput and speed of consolidating items for multi-item orders and/or consolidating packages that are destined for certain related destinations, such as other fulfillment centers. Some embodiments include optimized process flows for processing of orders at fulfillment centers, as well as process flows or equipment to increase speed of processing items or products and/or speed of emptying containers. As a result, throughput of fulfillment centers may be improved, and/or logistics of fulfillment center operations may be less complicated.

Referring to FIG. 1, an example use case 100 for sortation systems for various container types and an example process flow in accordance with one or more embodiments of the disclosure. Although discussed in the context of online orders, other embodiments may be directed to any suitable use case where products are processed and sorted.

In FIG. 1, a fulfillment center may include a robotic storage platform 110, a routing sorter 120, one or more item sorting systems 130, and one or more packing stations 140. The robotic storage platform 110 may be a portion of the fulfillment center at which products picked from product inventory are placed. Inventory may be stored after being sorted using systems having one or more forced air package redirection systems for improved fill rates as described herein.

Inventory may be stored in containers in foldable containers in some instances. Robots may be used to pick products from inventory and to deliver to the robotic storage platform in some instances, while in other instances, manual effort or a combination thereof may be used to pick products. The picking process at the robotic storage platform may include locating a product in an order, obtaining the product, and sending the product to the robotic storage platform 110, such as via a conveyor belt. In the illustrated embodiment, products at the robotic storage platform 110 may be placed in a container, such as a tote. The tote may be assigned to, or otherwise associated with, a particular item sorting system machine in some instances. For example, a certain tote may be associated with a certain item sorting system, such that products that are designated to be picked and placed in the tote are for orders that are to be consolidated at that particular item sorting system. The association between the tote and the item sorting system may be static in some instances. In other embodiments, there may not be any association between totes and item sorting systems, or associations may be dynamic.

At the routing sorter 120, totes including products that have been picked may be routed to the appropriate or designated item sorting system. For example, the routing sorter 120 may optionally determine an identifier associated with the tote, and may determine one or more item sorting systems to which the tote is to be routed using the identifier or using another factor, such as sortation system load. The routing sorter 120 may route or direct the tote to an item sorting system.

The item sorting systems 130 may include one or more item sorting system machines. In FIG. 1, a first item sorting system 132, a second item sorting system 134, a third item sorting system 136, and so forth may be included. Any number of item sorting systems may be included. Some or all of the item sorting systems may optionally be associated with certain totes. The item sorting systems may be used to consolidate or otherwise aggregate products for single or multi-item orders and/or for transfer to a different fulfillment center. For example, a first tote may include a first item of a multi-item order, and a second tote may include a second item of the multi-item order. The item sorting system may therefore identify the orders associated with the respective products in a tote, and may transport the products to a container, such as a tote, a flexible container, a specific chute leading to a container, or a different container associated with the order. When the order is complete with all of the products in the associated chute or container, the order may be packed. In instances where a container is designated for a different fulfillment center, as opposed to an online order, the container may be packed when full, as opposed to when certain items are placed into the container (e.g., there may not be any specific items that need to be in the container before packing, rather, the container may just be a certain threshold full, etc.). Accordingly, a specific item sorting system may be designated for fulfillment of a particular multi-item order. As a result, all of the products in the multi-item order may be placed in totes that are directed to that particular item sorting system. At the item sorting systems 130, totes that are received via the routing sorter 120 may be emptied, and the products in the respective totes may be transported to the appropriate chutes or containers for the orders for which the products were picked.

At the fulfillment center, an example process flow 150 illustrated in FIG. 1 may be implemented to improve the efficiency and/or throughput of the fulfillment center. At a first block 160, items may be picked from the robotic storage platform 110 into a tote that may optionally be associated with a specific item sorting system. At a second block 170, the tote may be sent to the routing sorter 120 for routing to an item sorting system. At a third block 180, the items from the tote may be sorted for an order with multiple item by the specific item sorting system. At a fourth block 190, the items may be packed into a shipment when all of the items in the order are sorted.

Figure 2:
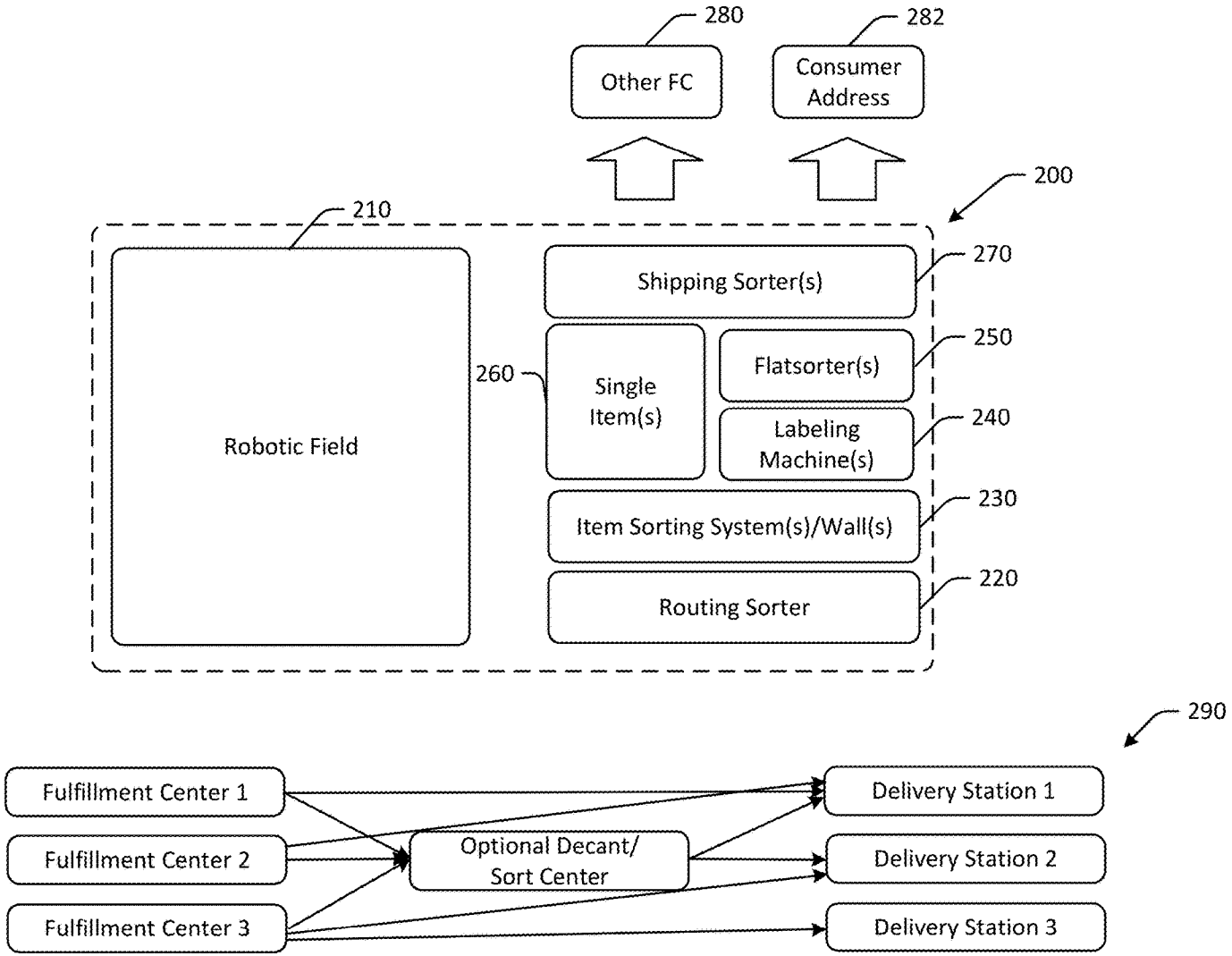
FIG. 2 is a hybrid schematic illustration of an example use case for forced air package redirection systems for improved fill rates in accordance with one or more embodiments of the disclosure.

FIG. 2 is a hybrid schematic illustration of an example use case for forced air package redirection systems for improved fill rates in accordance with one or more embodiments of the disclosure. Other embodiments may include additional or fewer components.

In FIG. 2, an example layout of a fulfillment center 200 is depicted. The fulfillment center 200 may include a robotic field 210 at which product inventory may be stored for picking (e.g., optionally in one or more flexible container pods, etc.), one or more routing sorters 220 that may be used to direct totes or other containers to item sorting systems, one or more item sorting systems or walls 230 used to consolidate products for multi-item orders and/or to pack multi-item orders, one or more single item sections 260 that may be used to pack single item orders, one or more labeling machines 240 that may be used to apply shipping labels to packages, one or more flat sorters 250 and shipping sorters 270 to sort labeled shipments (e.g., by destination, carrier, etc.) for pickup from the fulfillment center 200.

In some embodiments, the item sorting systems described herein may be a part of the flat sorters 250, where the item sorting systems may be configured to sort packages into containers or chutes. In such embodiments, the item sorting systems may or may not also be used at the item sorting systems 230 portion of the fulfillment center 200. Accordingly, the item sorting systems may be disposed at, or otherwise coupled to, a cross belt conveyor system, such as the flat sorters 250 of the fulfillment center 200.

The item sorting system machines 230 may include containers and/or containers of different sizes (e.g., small, medium, large, etc.) and may be configured, in one example, to handle items that weigh up to twenty or more pounds (e.g., 100 pounds or more, etc.). In some embodiments, the item sorting system machines 230 may include multiple chutes, such as about 328 chutes, and may be configured to sort items at a rate of about 2,100 units per hour or more. In some instances, the item sorting system machines 230 may have two inductors (e.g., one on each side, etc.), and may be modular. For example, the item sorting system machines 230 may each include sixteen expansion modules, where expansion modules may be defined as three two-sided columns next to one another for a total length of about 80 feet. The item sorting system machines 230 may reduce labor and capital costs associated with processing orders.

In some embodiments, the item sorting system 230 may replace other processes, such as manual processes. The item sorting system 230 may be a cross-belt shuttle sorter that sorts singulated products into containers or totes. Item sorting systems 230 may be capable of sorting at a rate of 2,100 units per hour or more. Certain item sorting systems 230 may be configured to handle items of up to twenty pounds, or more in some instances, with dimensions of about 18"×14"×8" or greater, which may cover almost all products at the fulfillment center 200. The item sorting systems 230 may operate as a high-speed, high-destination sort solution that intakes items or packages and sorts them into containers using a shuttle that travels vertically and horizontally inside the machine (or outside in some instances).

Individual item sorting system machines may be item sorting systems, and may include a number of, such as two or more, modular sorting machines coupled in series, or otherwise adjacent to each other and connected. The modular sorting machines may include a first modular sorting machine. The modular sorting machines may be configured to singulate items from a tote including a plurality of items into a plurality of chutes or containers (e.g. induct individual items from a container that has multiple items, and place the inducted items into the appropriate chute to be routed to a container, where chutes or containers are associated with multi-item orders). The tote from which items are inducted may be associated with the individual item sorting system machine (e.g., the modular sorting machines that form the individual item sorting system machine, etc.). In some embodiments, item sorting systems or individual item sorting machines may be configured to induct and sort packages based at least in part on a destination of the respective packages. Destinations may be internal destinations within a fulfillment center, external destinations to geographic regions or addresses, or other destination types. For example, output from the fulfillment center 200 may include containers of items routed to other fulfillment centers 280, packages addressed to consumer addresses 282, and so forth.

Accordingly, in some embodiments, item sorting systems may be arranged in rows and may receive totes from a routing sorter, thereby streamlining fulfillment center operation and reducing labor and space costs. The item sorting systems may process totes for multi-order sortation and consolidation. As a result, there may no longer be a need to singulate and send items to a wall for manual extraction, because each tote may be assigned to a particular item sorting system machine. Induct stations can be replaced with item sorting system machines.

In another embodiment, pickers may pick items directly to a segmented belt conveyor at a station that may be near an item sorting system machine. Other nearby pick stations may also pick items directly to conveyance for the same item sorting system machine. Picked items being transported to a single item sorting system machine may merge together to be inducted into their unique item sorting system machine, where multi-item orders may be consolidated and sent to packing.

Some embodiments may be used across facilities in a fulfillment network. An example fulfillment network 290 is depicted in FIG. 2. The fulfillment network 290 may include a number of fulfillment centers, a number of sort centers, a number of delivery stations, and so forth. The fulfillment centers may be used to pack items for fulfillment. Packed items may be routed to a sort center for redirection to an appropriate delivery station. In some instances, packed items may be routed directly to a delivery station while bypassing sort centers. Embodiments described herein may be used during sortation of items and/or packages or other related processes that may be part of a fulfillment network. At various points along the network of facilities, containers may be unloaded or emptied.

Example embodiments of the disclosure provide a number of technical features or technical effects. For example, in accordance with example embodiments of the disclosure, certain embodiments of the disclosure may improve processing speed, throughput, and/or efficiency of fulfillment centers. The above examples of technical features and/or technical effects of example embodiments of the disclosure are merely illustrative and not exhaustive.

One or more illustrative embodiments of the disclosure have been described above. The above-described embodiments are merely illustrative of the scope of this disclosure and are not intended to be limiting in any way. Accordingly, variations, modifications, and equivalents of the embodiments disclosed herein are also within the scope of this disclosure. The above-described embodiments and additional and/or alternative embodiments of the disclosure will be described in detail hereinafter through reference to the accompanying drawings.

ILLUSTRATIVE EMBODIMENTS AND USE CASES

Figure 3:
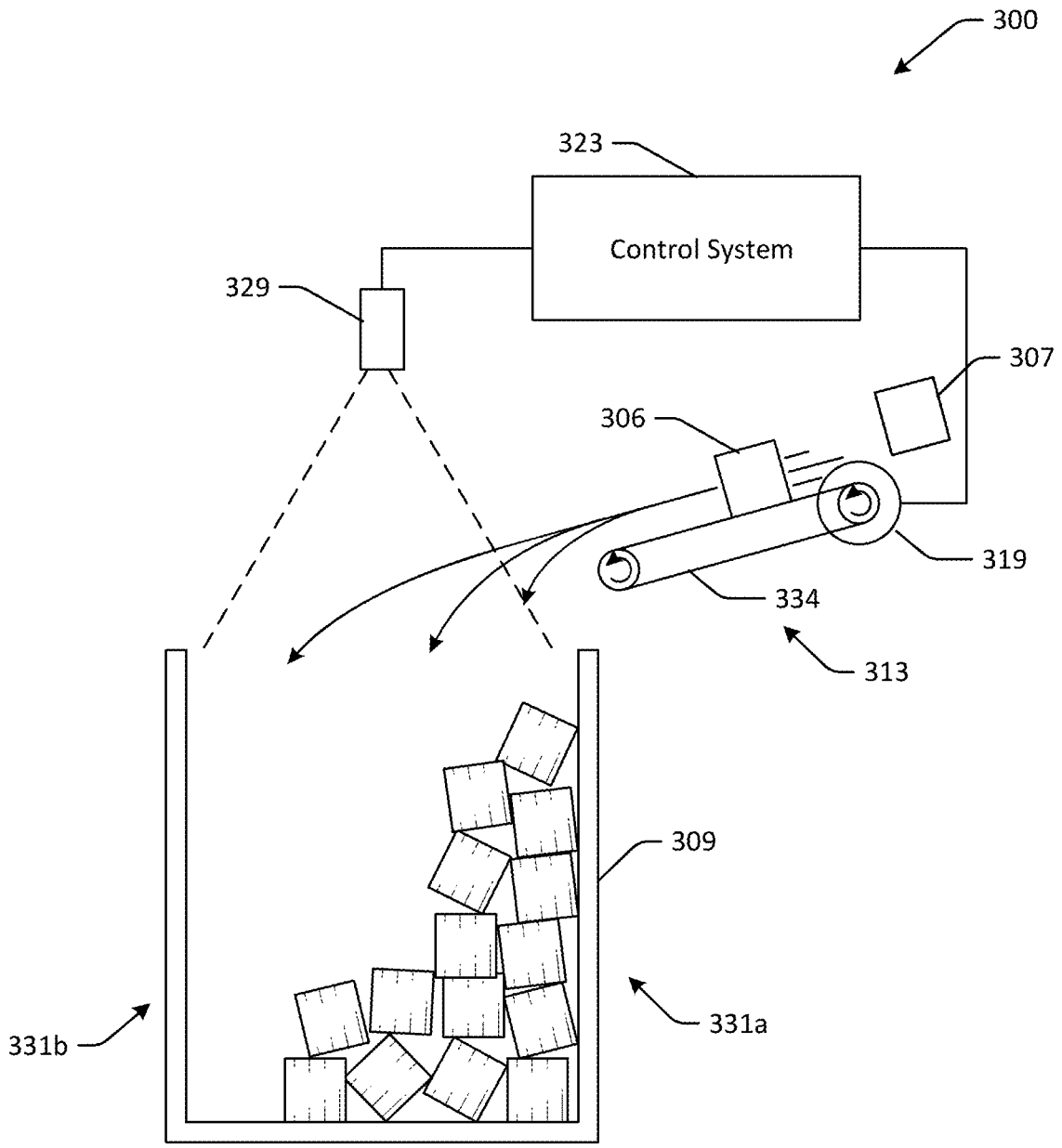
FIG. 3 is a schematic illustration of a diverter system and example package exit in accordance with one or more embodiments of the disclosure.

FIG. 3 is a schematic illustration of a diverter system 300 and example package exit in accordance with one or more embodiments of the disclosure. The illustration of FIG. 3 is not to scale, and may not be illustrated to scale with respect to other figures. The diverter system 300 may be the same diverter system discussed with respect to FIGS. 1-2.

In FIG. 3, shown is an example of an item diverter system 300 according to various embodiments. Among other systems and components, the item diverter system 300 can be part of a materials handling facility such as a fulfillment center. As shown in FIG. 3, the item diverter system 300 includes a drop chute which can transport an item 306 from a conveyor into a container 309. An item 306 can be representative of a parcel, package, box, bag, mailer, article of manufacture, or other product which is to be stored, transported, or organized in a materials handling facility. The drop chute can be configured to receive the item 306 from an upstream conveyor, chute, roller system, or other means of transporting and depositing items 306. In some embodiments, there is no drop chute, but rather a conveyor, a roller system, or another system which can be used to receive the item 306 and deposit it into the diverter 313. In some embodiments, the drop chute is made of metal, such as a sheet metal made out of aluminum, brass, copper, steel, tin, nickel, titanium, or other metal or composition of metals. In other embodiments, the drop chute is made of a plastic or other non-metal material. The drop chute can be made smooth by polishing or other approach to facilitate sliding of an item 306. In some embodiments, the item diverter system 300 can include one or more speed sensors disposed along the drop chute. These speed sensors can be representative of one or more sensors of various kinds which are configured to detect the speed of a passing item 306. For example, a speed sensor can be an electro-mechanical sensor triggered by the item 306 displacing a mechanical actuator. In some embodiments, the speed sensor can be pneumatic sensor detecting a change in air pressure when an item 306 passes.

In another example, the speed sensor can be a capacitive sensor detecting a change in an electrostatic field when an item 306 passes. Similarly, photoelectric sensors can be used as speed sensors by detecting a break in a light beam when an item 306 crosses its path. The speed sensors can be disposed at varying locations both within the drop chute and at various other positions within the item diverter system 300. For example, the drop chute can include multiple speed sensors at different locations within the drop chute, and the speed of an item 306 can be determined based at least in part on the time between triggering the sequential speed sensors. In some examples, there can be one or more speed sensors disposed on or about the diverter 313. The item diverter system 300 further includes an example of a diverter 313 which is used to divert an item 306 from the drop chute toward a container 309. While positioned downstream of the drop chute, the diverter 313 is a separate component of the item diverter system 300 and is usually not connected directly to the drop chute 303. Rather, the diverter 313 can be placed slightly below an exit end of the drop chute to receive an incoming item 306 from the drop chute. The diverter 313 can comprise a plate, a chute, a conveyor, a roller conveyor, or another component which serves to direct the item 306 toward the container 309. The diverter 313 can be connected to an actuator 319 and controlled by a control system 323, which may be the controller of FIG. 7. In some embodiments, the diverter 313 can be constructed from rigid material, semi-rigid material, flexible material, or other material.

The actuator 319 may be a motor or rotary actuator 319. In one embodiment, the conveyor diverter 313 includes a conveyor belt 334 which is driven by the actuator 319. As depicted in FIG. 3, activation of an air delivery system 307 to adjust velocity (in one example) of the item 306 as it moves along the conveyor belt 334 of the diverter 313 results in a corresponding change in the trajectory of an item 306 as it exits the diverter 313 and falls into the container 309.

As the velocity decreases, the item 306 is more likely to land on a near side 331*a* of the container 309. However, as the velocity increases, the item 306 is more likely to land on a far side 331*b* of the container 309. Accordingly, in the example depicted in FIG. 3, the control system 323 detects a void in the container 309 by way of a fill sensor 329. The control system 323 can then determine a velocity vector for the item 306, including the angle and magnitude of the velocity, required to get the item 306 to an intended position within the void. The control system 323 can generate control signals that are applied to the air delivery system 307. As depicted in FIG. 3, the air delivery system 307 reacts to the control signals and operates to adjust the speed of the item 306 by directing air onto the item 306. Once the item 306 is ejected from the diverter 313 and has landed in the container 309, the control system 323 detects the resting position of the item 306 by way of the fill sensor 329. In one embodiment, a closed loop system may be employed in which the control system 323 may be configured to generate a feedback based upon a difference between a resting position of the item 306 and the intended position of the item 306 or the void in the container 309. In this manner, the control system 323 can introduce feedback to fine tune the air pressure of the air delivery system 307.

Figure 4:
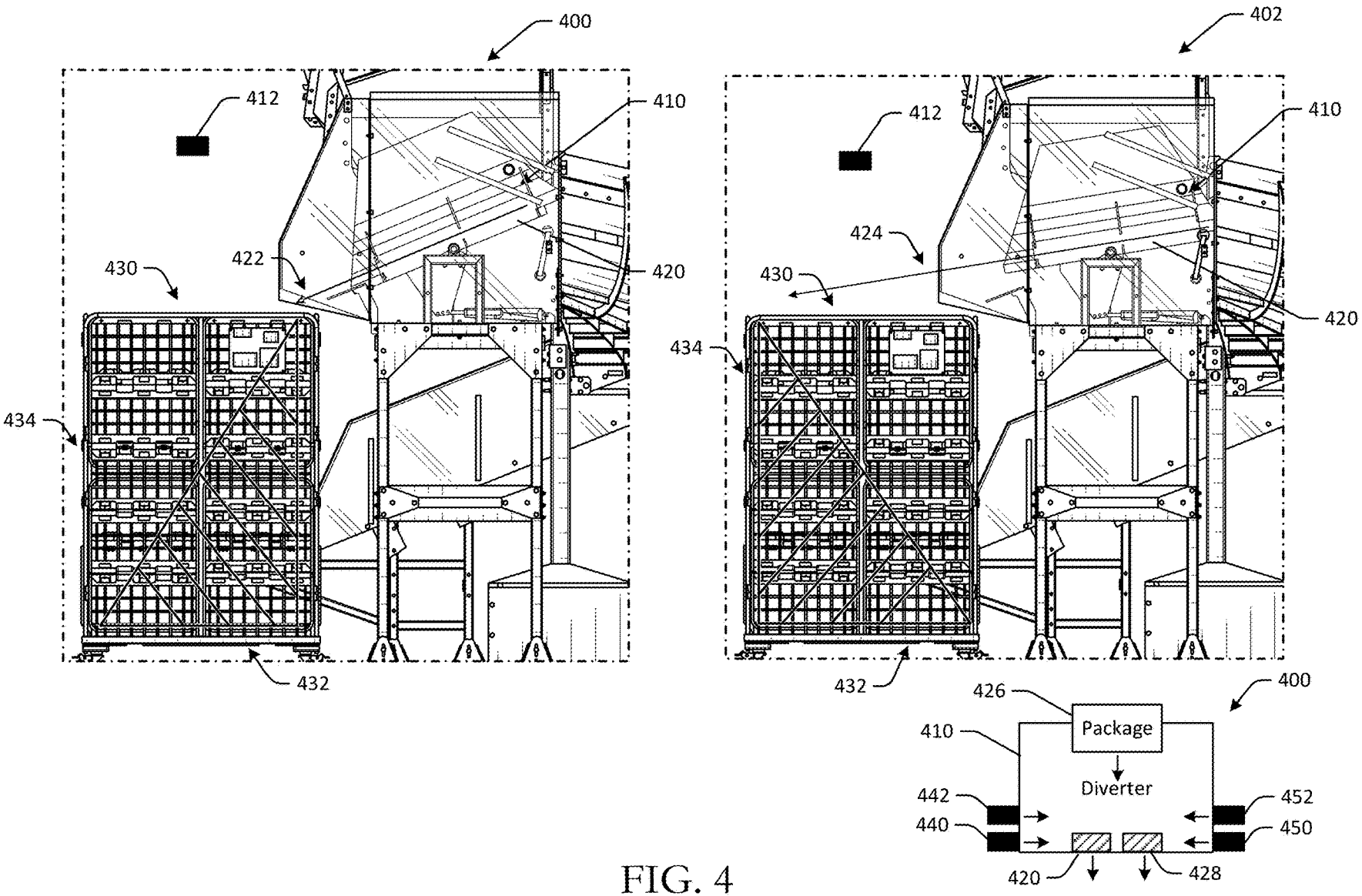
FIG. 4 is a schematic illustration of an example forced air package redirection system in various views in accordance with one or more embodiments of the disclosure.

FIG. 4 is a schematic illustration of an example forced air package redirection system 400 in various views in accordance with one or more embodiments of the disclosure. Other embodiments may include additional or fewer components. The conveyor and/or brush roller systems discussed with respect to FIG. 4 may be the same systems discussed with respect to FIGS. 1-3.

In FIG. 4, the conveyor system 400 may be configured to sort packages from various upstream destinations to downstream destinations, such as from a diverter 410, which may be an active or passive conveyor, to a container 430. The sorted packages may be handled for downstream processing. The forced air package redirection system 400 may be a sortation system. The forced air package redirection system 400 may include the diverter 410 configured to guide packages into the container 430, where the diverter 410 can include an active conveyance surface such as a conveyor belt.

The forced air package redirection system 400 may include a first air delivery device 420 configured to direct air 422 at a package 426 as it moves along the diverter 410 and/or after it is ejected from the diverter 410. In some embodiments, the first air delivery device 420 is disposed below the diverter 410, such as in the example of FIG. 4. The first air delivery device 420 may be at least one of an array of independent air jets (e.g., independently controlled, etc.), an individual air jet, an air blade, and/or a fan. Air delivery devices, in some instances, may include pneumatic valves, orifices, air knifes, fans, blowers, etc. The air delivery devices may have various configurations, such as baffles or orifices to distribute different locations, and may have different air output profiles, such as bursts, continuous application of force, etc.

The forced air package redirection system 400 may include a sensor 412 configured to image the container 430. In some embodiments, the sensor 412 may be configured to image an overhead view of the container 430. The sensor 412 may be a fill sensor as discussed herein, and may be a 3D sensor, a camera, a depth sensor, or other type of imaging sensor.

The forced air package redirection system 400 may include a controller configured to control operation of the first air delivery device 420. In some embodiments, the forced air package redirection system 400 may include an air pressure sensor 427 configured to measure air pressure in an air pressure line that feeds the first air delivery device 420. In some embodiments, the first air delivery device 420 is a compressed air delivery device that uses compressed air to generate the air output 422.

Some embodiments may include more than one air delivery device. For example, the forced air package redirection system 400 may include a second air delivery device 440 configured to direct air at the package 426, where the second air delivery device 440 is disposed at a side of the diverter 410. In this manner, lateral movement of the package 426 can also be manipulated using airflow. An array of air delivery devices may be included. For example, a third air delivery device 442 may be disposed adjacent to the second air delivery device 440. A fourth air delivery device 450 may be disposed opposite the second air delivery device 440, and a fifth air delivery device 452 may be disposed opposite the third air delivery device 442. A sixth air delivery device 428 may be disposed adjacent to the first air delivery device 420. Any number of air delivery devices may be included and may provide more granular control over package placement.

In the example of FIG. 4, a front end 432 of the container 430 may be determined to be more full than a rear end 434 of the container 430. As a result, the controller may cause the first air delivery device 420 to eject air 422 in a flow path 424 that causes the package 426 to land in the rear end 434 of the container 430, thereby increasing the utilization of the container 430 without the container 430 being categorized as full. Some embodiments may include a backstop configured to prevent the package from exiting the container 430, such as adjacent to the rear end 434 of the container 430.

Figure 5:
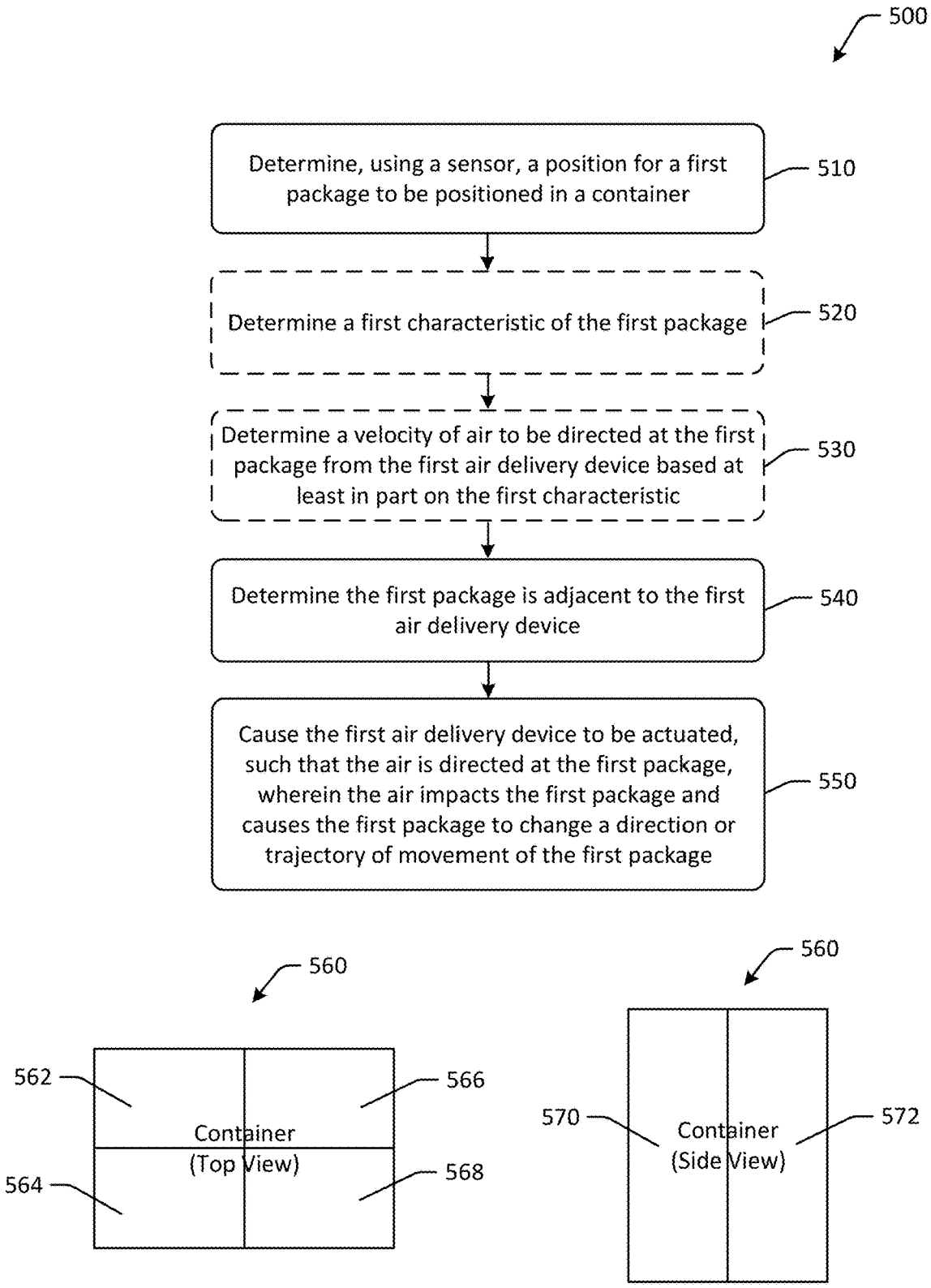
FIG. 5 is an example process flow for improved fill rates using a force air package redirection system in accordance with one or more embodiments of the disclosure.
Figure 6:
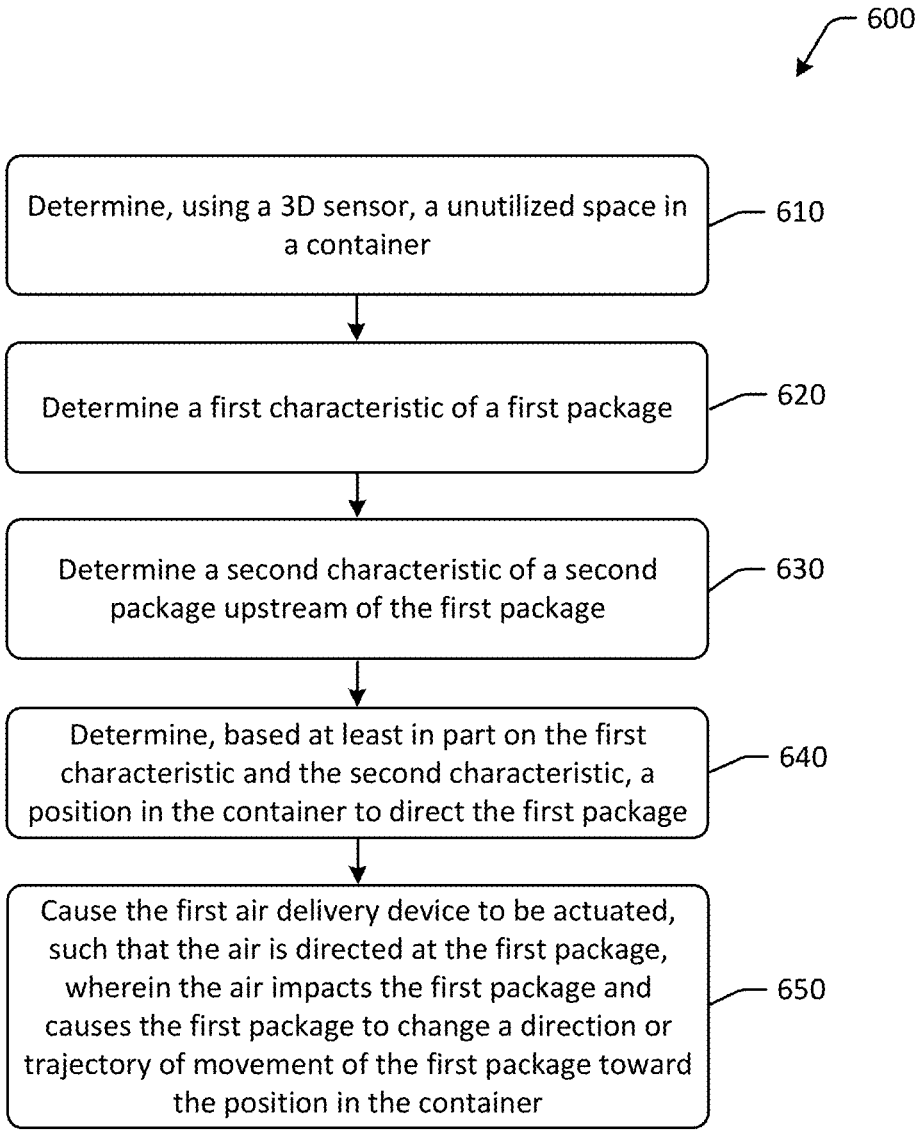
FIG. 6 is an example process flow for improved fill rates using a force air package redirection system in accordance with one or more embodiments of the disclosure.

As discussed at least with respect to FIGS. 5 and 6, the controller of the system may determine when packages are about to eject, and can time the air output 422 to coincide with package eject. The air output 422 may be used to guide the package 426 to a certain position or region of the container 430 that results in optimal utilization. For embodiments with arrays of air delivery devices, some or each can be controlled by an independently addressable valve. Arrays can be one or two dimensional. Some embodiments induce lateral control over where the package lands using the additional air delivery devices.

FIG. 5 depicts an example process flow 500 for improved fill rates using a force air package redirection system in accordance with one or more embodiments of the disclosure. While example embodiments of the disclosure may be described in the context of packages, it should be appreciated that the disclosure is more broadly applicable to any type of items being sorted. Some or all of the blocks of the process flows in this disclosure may be performed in a distributed manner across any number of devices. The operations of the process flow 500 may be optional and may be performed in a different order.

The process flow 500 may be executed by a controller having one or more computer processors and may be performed in conjunction with a forced air package redirection system as described herein. The forced air package redirection system may include a 3D sensor configured to image and measure the current fill surface of the container. The controller may use imaging to determine the presence of packages and/or empty space. The controller may determine an optimal position for subsequent packages. The forced air package redirection system may use any suitable airflow source, such as a ducted fan, a compressed air reservoir/line, etc. The forced air package redirection system can be retrofitted to existing sortation systems. Some embodiments may use an industrial blower with custom orifice/baffles for optimized airflow and adding directionality. The controller may use pulse width modulation signals to change revolutions per minute and modulate the air pressure of air output by the air delivery systems.

At block 510 of the process flow 500, computer-executable instructions stored on a memory of a device, such as a remote server or a forced air package redirection system, may be executed to determine, using a sensor, a position for a first package to be positioned in the container. For example, a controller of the forced air package redirection system may determine, using the sensor, a position for a first package to be positioned in the container. The controller may determine one or more images, such as a 3D image, point cloud, RGB image, composite images, and/or another type of image. Using the image, the controller may determine an underutilized portion of the container, which may be empty space in the container. The controller may determine a relatively empty portion of the container (e.g., a front half, back half, left half, right half, etc.) at which to target for landing of a package. Some controllers may be configured for more granular control, such as a particular quadrant of the container. For example, schematic drawings of a container 560 in a top view show example quadrants of a front-left quadrant 564, a front-right quadrant 568, a rear-left quadrant 562, a rear-right quadrant 566, and so forth. In another example, the controller may determine a position of a front half 572 or a rear half 570 of the container 560 as depicted in side view. The position may be a target landing area for the package as it is dropped into the container. In some embodiments, the position may be at least one of a front side of the container, a rear side of the container, a left side of the container, or a right side of the container.

At optional block 520 of the process flow 500, computer-executable instructions stored on a memory of a device, such as a remote server or a forced air package redirection system, may be executed to determine a first characteristic of the package. For example, the controller may determine a first characteristic of the package. In some instances, the controller may determine a size or dimensions of the package, a weight of the package, a geometry of the package, and so forth. Any number of characteristics may be determined. The first characteristic may be determined by imaging the package, by determining package data associated with the package as it is routed, and so forth.

At optional block 530 of the process flow 500, computer-executable instructions stored on a memory of a device, such as a remote server or a forced air package redirection system, may be executed to determine a velocity of air to be directed at the first package from the first air delivery device based at least in part on the first characteristic. For example, the controller may determine a velocity of air to be directed at the first package from the first air delivery device based at least in part on the first characteristic. In some embodiments, the velocity may be increased for packages having greater sizes or masses, smaller surface areas, and so forth. Other embodiments may modify other variables instead of, or in addition to velocity, such as angle of the air output, which air delivery devices to activate, and so forth.

At block 540 of the process flow 500, computer-executable instructions stored on a memory of a device, such as a remote server or a forced air package redirection system, may be executed to determine the first package is adjacent to the first air delivery device. For example, the controller may determine the first package is adjacent to the first air delivery device. The package may be determined to be coming down the diverter or chute based on a proximity or other type of sensor, and may trigger activation of the air delivery device. In other embodiments, imaging may be used to determine the package is adjacent to the air delivery device. The air delivery device may be activated before the package is in the airstream output by the air delivery device.

At block 550 of the process flow 500, computer-executable instructions stored on a memory of a device, such as a remote server or a forced air package redirection system, may be executed to cause the first air delivery device to be actuated, such that the air is directed at the first package, where the air impacts the first package and causes the first package to change a direction or trajectory of movement of the first package. For example, the controller may cause the first air delivery device to be actuated, such that the air is directed at the first package, where the air impacts the first package and causes the first package to change a direction or trajectory of movement of the first package. The air output from the air delivery device may impart momentum to the package as the package moves past the air output, and the resultant trajectory (e.g., distance or angle of travel as the package leaves the diverter or chute, etc.) is modified. In some embodiments, the direction of travel may be modified using air delivery devices disposed on lateral sides of the diverter or overall system.

FIG. 6 depicts an example process flow 600 for improved fill rates using a force air package redirection system in accordance with one or more embodiments of the disclosure. While example embodiments of the disclosure may be described in the context of packages, it should be appreciated that the disclosure is more broadly applicable to any type of items being sorted. Some or all of the blocks of the process flows in this disclosure may be performed in a distributed manner across any number of devices. The operations of the process flow 600 may be optional and may be performed in a different order.

The process flow 600 may be executed by a controller having one or more computer processors and may be performed in conjunction with a forced air package redirection system as described herein. The forced air package redirection system may include a 3D sensor configured to image and measure the current fill surface of the container. The controller may use imaging to determine the presence of packages and/or empty space. The controller may determine an optimal position for subsequent packages. The forced air package redirection system may use any suitable airflow source, such as a ducted fan, a compressed air reservoir/line, etc. The forced air package redirection system can be retrofitted to existing sortation systems. Some embodiments may use an industrial blower with custom orifice/baffles for optimized airflow and adding directionality. The controller may use pulse width modulation signals to change revolutions per minute and modulate the air pressure of air output by the air delivery systems.

At block 610 of the process flow 600, computer-executable instructions stored on a memory of a device, such as a remote server or a forced air package redirection system, may be executed to determine, using a 3D sensor, unutilized space in a container. For example, a controller of the item manipulation device and/or item manipulation system may determine, using a 3D sensor, unutilized space in a container. The controller may determine one or more images, such as a 3D image, point cloud, RGB image, composite images, and/or another type of image. Using the image, the controller may determine an underutilized portion of the container, which may be empty space in the container. The controller may determine a relatively empty portion of the container (e.g., a front half, back half, left half, right half, etc.) at which to target for landing of a package. Some controllers may be configured for more granular control, such as a particular quadrant of the container. The position may be a target landing area for the package as it is dropped into the container. In some embodiments, the position may be at least one of a front side of the container, a rear side of the container, a left side of the container, or a right side of the container.

At block 620 of the process flow 600, computer-executable instructions stored on a memory of a device, such as a remote server or a forced air package redirection system, may be executed to determine a first characteristic of the package. For example, the controller may determine a first characteristic of the package. In some instances, the controller may determine a size or dimensions of the package, a weight of the package, a geometry of the package, and so forth. Any number of characteristics may be determined. The first characteristic may be determined by imaging the package, by determining package data associated with the package as it is routed, and so forth.

At block 630 of the process flow 600, computer-executable instructions stored on a memory of a device, such as a remote server or a forced air package redirection system, may be executed to determine a second characteristic of a second package upstream of the first package. For example, the controller may determine a second characteristic of a second package upstream of the first package. The second package may have a greater size, dimensions, mass, or other characteristic than the first package. For example, the second package may be directly behind the first package and may be next to be deposited into the container. If the first package is a thin package, such as a paperback book or gift card, the first package may be directed to a suboptimal position to ensure free space remains for a large or odd shaped package (e.g., basketball, etc.) coming downstream, rather than placing the first thin package in an optimal position. In this manner, positioning can be optimized not only for a package currently being deposited into the container, but for additional packages routed to the container.

At block 640 of the process flow 600, computer-executable instructions stored on a memory of a device, such as a remote server or a forced air package redirection system, may be executed to determine, based at least in part on the first characteristic and the second characteristic, a position in the container to direct the first package. For example, the controller may determine, based at least in part on the first characteristic and the second characteristic, a position in the container to direct the first package. The positioning may be determined not only on available space in the container, but also on the dimensions or other characteristics of the immediate package and upstream packages.

At block 650 of the process flow 600, computer-executable instructions stored on a memory of a device, such as a remote server or a forced air package redirection system, may be executed to cause the first air delivery device to be actuated, such that the air is directed at the first package, where the air impacts the first package and causes the first package to change a direction or trajectory of movement of the first package. For example, the controller may cause the first air delivery device to be actuated, such that the air is directed at the first package, where the air impacts the first package and causes the first package to change a direction or trajectory of movement of the first package. The air output from the air delivery device may imping the package as the package moves past the air output, and the resultant trajectory (e.g., distance or angle of travel as the package leaves the diverter or chute, etc.) is modified. In some embodiments, the direction of travel may be modified using air delivery devices disposed on lateral sides of the diverter or overall system.

One or more operations of the methods, process flows, or use cases of FIGS. 1-6 may have been described above as being performed by a user device, or more specifically, by one or more program module(s), applications, or the like executing on a device. It should be appreciated, however, that any of the operations of the methods, process flows, or use cases of FIGS. 1-6 may be performed, at least in part, in a distributed manner by one or more other devices, or more specifically, by one or more program module(s), applications, or the like executing on such devices. In addition, it should be appreciated that processing performed in response to the execution of computer-executable instructions provided as part of an application, program module, or the like may be interchangeably described herein as being performed by the application or the program module itself or by a device on which the application, program module, or the like is executing. While the operations of the methods, process flows, or use cases of FIGS. 1-6 may be described in the context of the illustrative devices, it should be appreciated that such operations may be implemented in connection with numerous other device configurations.

The operations described and depicted in the illustrative methods, process flows, and use cases of FIGS. 1-6 may be carried out or performed in any suitable order, such as the depicted orders, as desired in various example embodiments of the disclosure. Additionally, in certain example embodiments, at least a portion of the operations may be carried out in parallel. Furthermore, in certain example embodiments, less, more, or different operations than those depicted in FIGS. 1-6 may be performed.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by the execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Illustrative Computer Architecture

Figure 7:
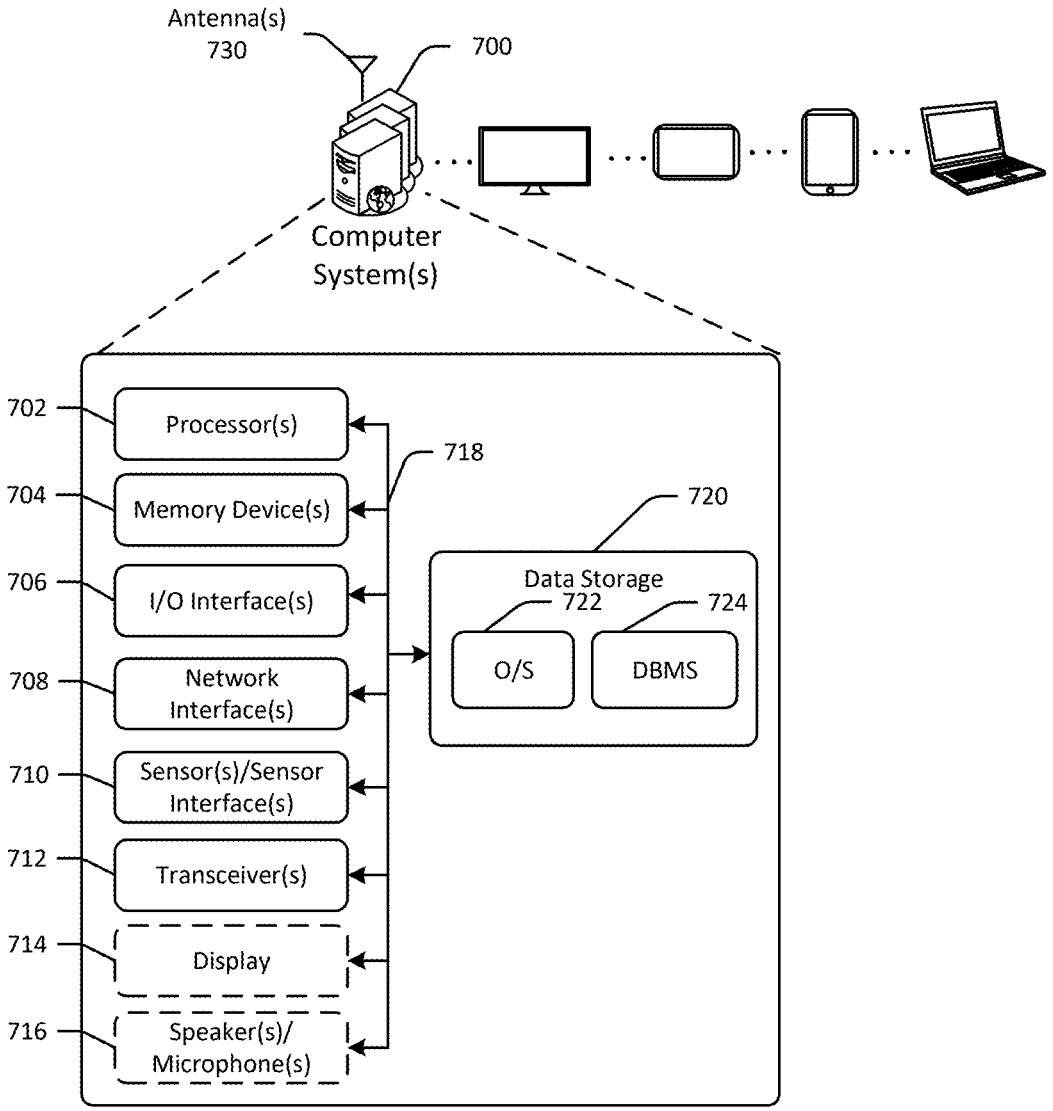
FIG. 7 schematically illustrates an example architecture of a computer system associated with a package redirection system in accordance with one or more embodiments of the disclosure.

FIG. 7 is a schematic block diagram of one or more illustrative computer system(s) 700 in accordance with one or more example embodiments of the disclosure. The computer system(s) 700 may include any suitable computing device including, but not limited to, a server system, a voice interaction device, a mobile device such as a smartphone, a tablet, an e-reader, a wearable device, or the like; a desktop computer; a laptop computer; a content streaming device; or the like. The computer system(s) 700 may correspond to an illustrative device configuration for a computer system used in conjunction with any one of the package redirection system(s) of FIGS. 1-6, such as diverter systems, forced airflow systems, compressed airflow systems, segment conveyors, and/or other conveyor devices.

The computer system(s) 700 may be configured to communicate with one or more servers, user devices, or the like. The computer system(s) 700 may be configured to cause the package redirection system(s) to actuate one or more air delivery devices, detect packages, transport packages, and so forth.

The computer system(s) 700 may be configured to communicate via one or more networks. Such network(s) may include, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks. Further, such network(s) may have any suitable communication range associated therewith and may include, for example, global networks (e.g., the Internet), metropolitan area networks (MANs), wide area networks (WANs), local area networks (LANs), or personal area networks (PANs). In addition, such network(s) may include communication links and associated networking devices (e.g., link-layer switches, routers, etc.) for transmitting network traffic over any suitable type of medium including, but not limited to, coaxial cable, twisted-pair wire (e.g., twisted-pair copper wire), optical fiber, a hybrid fiber-coaxial (HFC) medium, a microwave medium, a radio frequency communication medium, a satellite communication medium, or any combination thereof.

In an illustrative configuration, the computer system(s) 700 may include one or more processors (processor(s)) 702, one or more memory devices 704 (also referred to herein as memory 704), one or more input/output (I/O) interface(s) 706, one or more network interface(s) 708, one or more sensor(s) or sensor interface(s) 710, one or more transceiver(s) 712, one or more optional display(s) 714, one or more optional microphone(s) 716, and data storage 720. The computer system(s) 700 may further include one or more bus(es) 718 that functionally couple various components of the computer system(s) 700. The computer system(s) 700 may further include one or more antenna(s) 730 that may include, without limitation, a cellular antenna for transmitting or receiving signals to/from a cellular network infrastructure, an antenna for transmitting or receiving Wi-Fi signals to/from an access point (AP), a Global Navigation Satellite System (GNSS) antenna for receiving GNSS signals from a GNSS satellite, a Bluetooth antenna for transmitting or receiving Bluetooth signals, a Near Field Communication (NFC) antenna for transmitting or receiving NFC signals, and so forth. These various components will be described in more detail hereinafter.

The bus(es) 718 may include at least one of a system bus, a memory bus, an address bus, or a message bus, and may permit the exchange of information (e.g., data (including computer-executable code), signaling, etc.) between various components of the computer system(s) 700. The bus(es) 718 may include, without limitation, a memory bus or a memory controller, a peripheral bus, an accelerated graphics port, and so forth. The bus(es) 718 may be associated with any suitable bus architecture including, without limitation, an Industry Standard Architecture (ISA), a Micro Channel Architecture (MCA), an Enhanced ISA (EISA), a Video Electronics Standards Association (VESA) architecture, an Accelerated Graphics Port (AGP) architecture, a Peripheral Component Interconnect (PCI) architecture, a PCI-Express architecture, a Personal Computer Memory Card International Association (PCMCIA) architecture, a Universal Serial Bus (USB) architecture, and so forth.

The memory 704 of the computer system(s) 700 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. Persistent data storage, as that term is used herein, may include non-volatile memory. In certain example embodiments, volatile memory may enable faster read/write access than non-volatile memory. However, in certain other example embodiments, certain types of non-volatile memory (e.g., FRAM) may enable faster read/write access than certain types of volatile memory.

In various implementations, the memory 704 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth. The memory 704 may include main memory as well as various forms of cache memory such as instruction cache(s), data cache(s), translation lookaside buffer(s) (TLBs), and so forth. Further, cache memory such as a data cache may be a multi-level cache organized as a hierarchy of one or more cache levels (L1, L2, etc.).

The data storage 720 may include removable storage and/or non-removable storage including, but not limited to, magnetic storage, optical disk storage, and/or tape storage. The data storage 720 may provide non-volatile storage of computer-executable instructions and other data. The memory 704 and the data storage 720, removable and/or non-removable, are examples of computer-readable storage media (CRSM) as that term is used herein.

The data storage 720 may store computer-executable code, instructions, or the like that may be loadable into the memory 704 and executable by the processor(s) 702 to cause the processor(s) 702 to perform or initiate various operations. The data storage 720 may additionally store data that may be copied to the memory 704 for use by the processor(s) 702 during the execution of the computer-executable instructions. Moreover, output data generated as a result of execution of the computer-executable instructions by the processor(s) 702 may be stored initially in the memory 704, and may ultimately be copied to the data storage 720 for non-volatile storage.

More specifically, the data storage 720 may store one or more operating systems (O/S) 722; one or more database management systems (DBMS) 724; and one or more program module(s), applications, engines, computer-executable code, scripts, or the like. Some or all of these module(s) may be sub-module(s). Any of the components depicted as being stored in the data storage 720 may include any combination of software, firmware, and/or hardware. The software and/or firmware may include computer-executable code, instructions, or the like that may be loaded into the memory 704 for execution by one or more of the processor(s) 702. Any of the components depicted as being stored in the data storage 720 may support functionality described in reference to corresponding components named earlier in this disclosure.

The data storage 720 may further store various types of data utilized by the components of the computer system(s) 700. Any data stored in the data storage 720 may be loaded into the memory 704 for use by the processor(s) 702 in executing computer-executable code. In addition, any data depicted as being stored in the data storage 720 may potentially be stored in one or more datastore(s) and may be accessed via the DBMS 724 and loaded in the memory 704 for use by the processor(s) 702 in executing computer-executable code. The datastore(s) may include, but are not limited to, databases (e.g., relational, object-oriented, etc.), file systems, flat files, distributed datastores in which data is stored on more than one node of a computer network, peer-to-peer network datastores, or the like.

The processor(s) 702 may be configured to access the memory 704 and execute the computer-executable instructions loaded therein. For example, the processor(s) 702 may be configured to execute the computer-executable instructions of the various program module(s), applications, engines, or the like of the computer system(s) 700 to cause or facilitate various operations to be performed in accordance with one or more embodiments of the disclosure. The processor(s) 702 may include any suitable processing unit capable of accepting data as input, processing the input data in accordance with stored computer-executable instructions, and generating output data. The processor(s) 702 may include any type of suitable processing unit including, but not limited to, a central processing unit, a microprocessor, a Reduced Instruction Set Computer (RISC) microprocessor, a Complex Instruction Set Computer (CISC) microprocessor, a microcontroller, an Application Specific Integrated Circuit (ASIC), a Field-Programmable Gate Array (FPGA), a System-on-a-Chip (SoC), a digital signal processor (DSP), and so forth. Further, the processor(s) 702 may have any suitable microarchitecture design that includes any number of constituent components such as, for example, registers, multiplexers, arithmetic logic units, cache controllers for controlling read/write operations to cache memory, branch predictors, or the like. The microarchitecture design of the processor(s) 702 may be capable of supporting any of a variety of instruction sets.

Referring now to other illustrative components depicted as being stored in the data storage 720, the O/S 722 may be loaded from the data storage 720 into the memory 704 and may provide an interface between other application software executing on the computer system(s) 700 and the hardware resources of the computer system(s) 700. More specifically, the O/S 722 may include a set of computer-executable instructions for managing the hardware resources of the computer system(s) 700 and for providing common services to other application programs (e.g., managing memory allocation among various application programs). In certain example embodiments, the O/S 722 may control execution of the other program module(s). The O/S 722 may include any operating system now known or which may be developed in the future including, but not limited to, any server operating system, any mainframe operating system, or any other proprietary or non-proprietary operating system.

The DBMS 724 may be loaded into the memory 704 and may support functionality for accessing, retrieving, storing, and/or manipulating data stored in the memory 704 and/or data stored in the data storage 720. The DBMS 724 may use any of a variety of database models (e.g., relational model, object model, etc.) and may support any of a variety of query languages. The DBMS 724 may access data represented in one or more data schemas and stored in any suitable data repository including, but not limited to, databases (e.g., relational, object-oriented, etc.), file systems, flat files, distributed datastores in which data is stored on more than one node of a computer network, peer-to-peer network datastores, or the like. In those example embodiments in which the computer system(s) 700 is a mobile device, the DBMS 724 may be any suitable lightweight DBMS optimized for performance on a mobile device.

Referring now to other illustrative components of the computer system(s) 700, the input/output (I/O) interface(s) 706 may facilitate the receipt of input information by the computer system(s) 700 from one or more I/O devices as well as the output of information from the computer system(s) 700 to the one or more I/O devices. The I/O devices may include any of a variety of components such as a display or display screen having a touch surface or touchscreen; an audio output device for producing sound, such as a speaker; an audio capture device, such as a microphone; an image and/or video capture device, such as a camera; a haptic unit; and so forth. Any of these components may be integrated into the computer system(s) 700 or may be separate. The I/O devices may further include, for example, any number of peripheral devices such as data storage devices, printing devices, and so forth.

The I/O interface(s) 706 may also include an interface for an external peripheral device connection such as universal serial bus (USB), FireWire, Thunderbolt, Ethernet port or other connection protocol that may connect to one or more networks. The I/O interface(s) 706 may also include a connection to one or more of the antenna(s) 730 to connect to one or more networks via a wireless local area network (WLAN) (such as Wi-Fi) radio, Bluetooth, ZigBee, and/or a wireless network radio, such as a radio capable of communication with a wireless communication network such as a Long Term Evolution (LTE) network, WiMAX network, 3G network, a ZigBee network, etc.

The computer system(s) 700 may further include one or more network interface(s) 708 via which the computer system(s) 700 may communicate with any of a variety of other systems, platforms, networks, devices, and so forth. The network interface(s) 708 may enable communication, for example, with one or more wireless routers, one or more host servers, one or more web servers, and the like via one or more networks.

The antenna(s) 730 may include any suitable type of antenna depending, for example, on the communications protocols used to transmit or receive signals via the antenna(s) 730. Non-limiting examples of suitable antennas may include directional antennas, non-directional antennas, dipole antennas, folded dipole antennas, patch antennas, multiple-input multiple-output (MIMO) antennas, or the like. The antenna(s) 730 may be communicatively coupled to one or more transceivers 712 or radio components to which or from which signals may be transmitted or received.

As previously described, the antenna(s) 730 may include a cellular antenna configured to transmit or receive signals in accordance with established standards and protocols, such as Global System for Mobile Communications (GSM), 3G standards (e.g., Universal Mobile Telecommunications System (UMTS), Wideband Code Division Multiple Access (W-CDMA), CDMA2000, etc.), 4G standards (e.g., Long-Term Evolution (LTE), WiMax, etc.), direct satellite communications, or the like.

The antenna(s) 730 may additionally, or alternatively, include a Wi-Fi antenna configured to transmit or receive signals in accordance with established standards and protocols, such as the IEEE 802.11 family of standards, including via 2.4 GHz channels (e.g., 802.11b, 802.11g, 802.11n), 5 GHz channels (e.g., 802.11n, 802.11ac), or 60 GHz channels (e.g., 802.11ad). In alternative example embodiments, the antenna(s) 730 may be configured to transmit or receive radio frequency signals within any suitable frequency range forming part of the unlicensed portion of the radio spectrum.

The antenna(s) 730 may additionally, or alternatively, include a GNSS antenna configured to receive GNSS signals from three or more GNSS satellites carrying time-position information to triangulate a position therefrom. Such a GNSS antenna may be configured to receive GNSS signals from any current or planned GNSS such as, for example, the Global Positioning System (GPS), the GLONASS System, the Compass Navigation System, the Galileo System, or the Indian Regional Navigational System.

The transceiver(s) 712 may include any suitable radio component(s) for—in cooperation with the antenna(s) 730—transmitting or receiving radio frequency (RF) signals in the bandwidth and/or channels corresponding to the communications protocols utilized by the computer system(s) 700 to communicate with other devices. The transceiver(s) 712 may include hardware, software, and/or firmware for modulating, transmitting, or receiving—potentially in cooperation with any of antenna(s) 730—communications signals according to any of the communications protocols discussed above including, but not limited to, one or more Wi-Fi and/or Wi-Fi direct protocols, as standardized by the IEEE 802.11 standards, one or more non-Wi-Fi protocols, or one or more cellular communications protocols or standards. The transceiver(s) 712 may further include hardware, firmware, or software for receiving GNSS signals. The transceiver(s) 712 may include any known receiver and baseband suitable for communicating via the communications protocols utilized by the computer system(s) 700. The transceiver(s) 712 may further include a low noise amplifier (LNA), additional signal amplifiers, an analog-to-digital (A/D) converter, one or more buffers, a digital baseband, or the like.

The sensor(s)/sensor interface(s) 710 may include or may be capable of interfacing with any suitable type of sensing device such as, for example, inertial sensors, force sensors, thermal sensors, photocells, and so forth. Example types of inertial sensors may include accelerometers (e.g., MEMS-based accelerometers), gyroscopes, and so forth.

The optional display(s) 714 may be configured to output light and/or render content. The optional speaker(s)/microphone(s) 716 may be any device configured to receive analog sound input or voice data.

It should be appreciated that the program module(s), applications, computer-executable instructions, code, or the like depicted in FIG. 7 as being stored in the data storage 720 are merely illustrative and not exhaustive and that processing described as being supported by any particular module may alternatively be distributed across multiple module(s) or performed by a different module. In addition, various program module(s), script(s), plug-in(s), Application Programming Interface(s) (API(s)), or any other suitable computer-executable code hosted locally on the computer system(s) 700, and/or hosted on other computing device(s) accessible via one or more networks, may be provided to support functionality provided by the program module(s), applications, or computer-executable code depicted in FIG. 7 and/or additional or alternate functionality. Further, functionality may be modularized differently such that processing described as being supported collectively by the collection of program module(s) depicted in FIG. 7 may be performed by a fewer or greater number of module(s), or functionality described as being supported by any particular module may be supported, at least in part, by another module. In addition, program module(s) that support the functionality described herein may form part of one or more applications executable across any number of systems or devices in accordance with any suitable computing model such as, for example, a client-server model, a peer-to-peer model, and so forth. In addition, any of the functionality described as being supported by any of the program module(s) depicted in FIG. 7 may be implemented, at least partially, in hardware and/or firmware across any number of devices.

It should further be appreciated that the computer system(s) 700 may include alternate and/or additional hardware, software, or firmware components beyond those described or depicted without departing from the scope of the disclosure. More particularly, it should be appreciated that software, firmware, or hardware components depicted as forming part of the computer system(s) 700 are merely illustrative and that some components may not be present or additional components may be provided in various embodiments. While various illustrative program module(s) have been depicted and described as software module(s) stored in the data storage 720, it should be appreciated that functionality described as being supported by the program module(s) may be enabled by any combination of hardware, software, and/or firmware. It should further be appreciated that each of the above-mentioned module(s) may, in various embodiments, represent a logical partitioning of supported functionality. This logical partitioning is depicted for ease of explanation of the functionality and may not be representative of the structure of software, hardware, and/or firmware for implementing the functionality. Accordingly, it should be appreciated that functionality described as being provided by a particular module may, in various embodiments, be provided at least in part by one or more other module(s). Further, one or more depicted module(s) may not be present in certain embodiments, while in other embodiments, additional module(s) not depicted may be present and may support at least a portion of the described functionality and/or additional functionality. Moreover, while certain module(s) may be depicted and described as sub-module(s) of another module, in certain embodiments, such module(s) may be provided as independent module(s) or as sub-module(s) of other module(s).

Program module(s), applications, or the like disclosed herein may include one or more software components including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a computer-readable storage medium (CRSM) that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program module(s), or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

That which is claimed is:

1. A sortation system comprising:

a diverter configured to guide packages into a container;

a first air delivery device configured to direct air at the package, wherein the first air delivery device is disposed below the diverter;

a sensor configured to image the container; and a controller configured to:

determine, using the sensor, a position for a first package to be positioned in the container, wherein the position is at least one of: a front side of the container, a rear side of the container, a left side of the container, or a right side of the container;

determine a first characteristic of the package;

determine a velocity of air to be directed at the first package from the first air delivery device based at least in part on the first characteristic;

determine the first package is adjacent to the first air delivery device; and cause the first air delivery device to be actuated at the velocity, such that the air is directed at the first package;

wherein the air impacts the first package and causes the first package to change a direction or trajectory of movement of the first package.

2. The sortation system of claim 1, wherein the controller is further configured to:

determine a second characteristic of a second package upstream of the first package; and determine the position for the first package based at least in part on the second characteristic.

3. The sortation system of claim 1, further comprising:

a second air delivery device configured to direct air at the package;

wherein the second air delivery device is disposed at a side of the diverter.

4. The sortation system of claim 1, further comprising:

a backstop configured to prevent the package from exiting the container; and an air pressure sensor configured to measure air pressure in an air pressure line;

wherein the first air delivery device is a compressed air delivery device.

5. A sortation system comprising:

a diverter configured to guide packages into a container;

a first air delivery device configured to direct air at the package;

a sensor configured to image the container; and a controller configured to:

determine, using the sensor, a position for a first package to be positioned in the container;

determine the first package is adjacent to the first air delivery device; and cause the first air delivery device to be actuated, such that the air is directed at the first package;

wherein the air impacts the first package and causes the first package to change a direction or trajectory of movement of the first package.

6. The sortation system of claim 5, wherein the controller is further configured to:

determine a first characteristic of the package; and determine a velocity of air to be directed at the first package from the first air delivery device based at least in part on the first characteristic.

7. The sortation system of claim 6, wherein the controller is further configured to:

determine a second characteristic of a second package upstream of the first package; and determine the position for the first package based at least in part on the second characteristic.

8. The sortation system of claim 5, wherein the position is at least one of: a front side of the container, a rear side of the container, a left side of the container, or a right side of the container.

9. The sortation system of claim 5, wherein the first air delivery device is disposed below the diverter.

10. The sortation system of claim 9, further comprising:

a second air delivery device configured to direct air at the package;

wherein the second air delivery device is disposed at a side of the diverter.

11. The sortation system of claim 5, wherein the first air delivery device is at least one of an array of independent air jets, an air blade, or a fan.

12. The sortation system of claim 5, further comprising:

an air pressure sensor configured to measure air pressure in an air pressure line;

wherein the first air delivery device is a compressed air delivery device.

13. The sortation system of claim 5, further comprising:

a backstop configured to prevent the package from exiting the container.

14. The sortation system of claim 5, wherein the sensor is configured to image an overhead view of the container.

15. The sortation system of claim 5, wherein the diverter comprises an active conveyance surface.

16. A system comprising:

a diverter configured to guide packages into a container;

a first air delivery device configured to direct air at the package;

a sensor configured to image the container; and a controller configured to:

determine, using the sensor, a position for a first package to be positioned in the container, wherein the position is at least one of: a front side of the container, a rear side of the container, a left side of the container, or a right side of the container;

determine the first package is adjacent to the first air delivery device;

cause the first air delivery device to be actuated, such that the air is directed at the first package;

wherein the air impacts the first package and causes the first package to change a direction or trajectory of movement of the first package.

17. The system of claim 16, wherein the controller is further configured to:

determine a first characteristic of the package;

determine a velocity of air to be directed at the first package from the first air delivery device based at least in part on the first characteristic;

determine a second characteristic of a second package upstream of the first package; and determine the position for the first package based at least in part on the second characteristic.

18. The system of claim 16, wherein the first air delivery device is disposed below the diverter.

19. The system of claim 18, further comprising:

a second air delivery device configured to direct air at the package;

wherein the second air delivery device is disposed at a side of the diverter.

20. The system of claim 16, further comprising:

a backstop configured to prevent the package from exiting the container; and an air pressure sensor configured to measure air pressure in an air pressure line;

wherein the first air delivery device is a compressed air delivery device.

* * * * *